US006116869A

United States Patent [19]

Couillard et al.

[11] Patent Number: 6,116,869

[45] Date of Patent: Sep. 12, 2000

[54] PUMPING PROCESS AND SYSTEM FOR MIXING LIQUIDS

[75] Inventors: François Couillard, Yerres; André Renot, Franconville, both of France

[73] Assignee: Institut Francais du Petrole, Cedex, France

[21] Appl. No.: 09/148,322

[22] Filed: Sep. 4, 1998

[30] Foreign Application Priority Data

Sep. 5, 1997 [FR] France ..... 97 11149

[51] Int. Cl.[7] ..... F04B 23/02; F04B 53/00

[52] U.S. Cl. ..... 417/442; 417/503

[58] Field of Search ..... 417/442, 503, 417/505; 210/101

[56] References Cited

U.S. PATENT DOCUMENTS

| | | | |
|---|---|---|---|
| 2,811,925 | 11/1957 | Crookstron | 103/44 |
| 2,946,488 | 7/1960 | Kraft | 222/134 |
| 4,437,812 | 3/1984 | Abu-Shumays et al. | 417/53 |
| 4,475,821 | 10/1984 | Koch et al. | 366/160 |
| 4,595,496 | 6/1986 | Carson | 210/101 |
| 4,954,253 | 9/1990 | Alexandrov et al. | 210/198.2 |
| 5,253,981 | 10/1993 | Yang et al. | 417/3 |
| 5,755,561 | 5/1998 | Couillard et al. | 417/246 |
| 5,862,832 | 1/1999 | Victor et al. | 137/606 |

FOREIGN PATENT DOCUMENTS

| | | |
|---|---|---|
| 2726332 | 10/1994 | France . |
| 2725464 | 12/1978 | Germany . |
| 1505700 | 3/1978 | United Kingdom . |

*Primary Examiner*—Henry C. Yuen
*Assistant Examiner*—Arnold Castro
*Attorney, Agent, or Firm*—Antonelli, Terry, Stout & Kraus, LLP

[57] ABSTRACT

The present invention is a pumping system which mixes liquids with a well-controlled proportioning and flow rate. The pumping system according to the invention comprises a liquid mixing device (MX) placed upstream from a pump (P). The liquids are taken from vessels (RA, RB), cyclically introduced, in a determined proportion, in a mixing chamber (9) through alternate opening of on-off solenoid valves (EVA, EVB). The system is controlled at the input by using a damping means such as bellows (11A, 11B) in antechambers (8A, 8B) in order to avoid the effects of velocity discontinuities at the time of the opening and of the closing of the valves. The delivery of pump (P) is controlled at the input as well as at the discharge end. The system may be used for liquid chromatography plants.

40 Claims, 6 Drawing Sheets

PUMPING PROCESS AND SYSTEM FOR MIXING LIQUIDS

FIELD OF THE INVENTION

The present invention relates to a pumping process and system which mixes liquids with a well-controlled proportioning and flow rate.

It more particularly relates to a pumping system for mixing several liquids with determined proportioning by communicating cyclically various vessels containing the liquids to be mixed with the inlet of a pump by means of on-off valves.

DESCRIPTION OF THE PRIOR ART

Various types of pumps can be used for circulating liquid mixtures. Reciprocating pumps generally combining two pumping units PU1, PU2 (FIG. 1) are for example well-known. Each one of them comprises a piston 1 sliding in a cylinder 2 communicating, by means of a one-way valve 4 which opens during the suction phase, with an inlet line 3 coming from a first tee intended for delivery T1 of a liquid L. Units PU1, PU2 also communicate, by means of an outlet line 5 and of valves 6 opening during the discharge phase, with a second delivery tee T2. The two pumping units are phase shifted so that the suction phase of one pump corresponds to the discharge phase of the other.

The velocity of each piston decreases at the end of the stroke, and consequently so does the flow discharged thereby. If the global rate of discharge of the two units PU1, PU2 is to be kept substantially constant, the sum of the velocities of the two pistons 1 must remain constant and therefore the discharge phase of the other unit must start before the first one has ended. During the cycle fraction in which the two units discharge at the same time, the suction rate is of course zero.

It is well-known to perform mixing of liquids by connecting the inlet of a pump to several vessels containing the liquids to be mixed, by means of solenoid valves or air-operated valves for example. As shown diagrammatically in FIG. 2 for example, mixing of several liquids coming from vessels R1, R2, . . . , Rn for example is performed in a head H by means of on-off solenoid valves EV1, EV2, . . . , Evn placed at the inlet of a proportioning pump P of a well-known type that can comprise one or more heads, a constant or pulsed-capacity piston or diaphragm pump, such as for example the pump described in patent French Patent 2,726,332 (U.S. Pat. No. 5,755,561) filed by the assignee. The solenoid valves are successively opened with a cyclic permutation and according to a form factor which determines the desired percentage of liquid mixtures controlled by a control processor UC in order to obtain precise proportioning.

Mixing of liquids by alternate suction by means of on-off valves is an economical process since it requires a single pump (to be selected from all the pump types available on the market), an assembly of relatively cheap elements and a relatively simple valve control. On the other hand, the drawback of this method is that it causes noticeable proportioning variations and considerable variations in the flow pumped. This is mainly due to the working principle thereof.

In order to obtain good mixing precision, fast switching of the solenoid valves is necessary. In the following practical instance where a rotating cam pump with 60 rpm at maximum delivery rate is used, with a solenoid valve permutation cycle lasting 5 s for example, and if a mixture consisting of 1% of liquid A in the mixture A+B+C is to be obtained, the opening time of solenoid valve controlling flow of A (EV1 for example) must be 50 ms. If a 1% accuracy is sought, the cumulated duration of the switching times, O (open)+F (closed), must be much less than 5 ms, i.e. <2.5 ms per switching front. To guarantee this accuracy, solenoid valves whose switching times are of the order of 1 to 2 ms at most must normally be used.

Under such working conditions, the flow rates lead to liquid velocities in the suction pipes which can reach several meters per second.

Fast closing of valve (EV1 controlling flow of A causes sudden stopping of the column of liquid circulating therein for example at 2 m/s, which leads to an overpressure that delays the closing thereof and chances the desired percentage of constituent in the mixture.

Solenoid valve EV2 opens for example as solenoid valve EV1 closes. At the time of the simultaneous opening of solenoid valve EV2, the column of liquid contained in the suction pipe from vessel R2, which was motionless until then, must take the same velocity (2 m/s) as the column of liquid from vessel R1, in a time of the order of 1 ms. It can be readily checked that the pressure required for a sufficient acceleration is considerably higher than the atmospheric pressure. Since this is impossible, there are inevitably considerable cavitations in the liquid pumped and consequently considerable percentage and flow rate errors in the pumping system. As a result, the pumps with which this liquid mixing process is used generally have a pulsed suction rate. As the recurrence is never synchronous with the recurrence of the solenoid valve mixing system, there is a waiting time phenomenon with a cyclic proportioning variation of the resulting mixture.

SUMMARY OF THE INVENTION

The pumping process according to the invention provides mixing of various constituents with precise proportioning of each one of them, by cyclic communication of the vessels containing the constituents with the inlet of a pump by means of valves. The invention dumps cyclic variations in the velocity of the constituents caused by the opening and the closing of the valves.

Such a pumping system with well-controlled proportioning and flow rate can be used in many fields and notably in chromatography systems.

Deformable volumes whose volume varies in relation to the cyclic velocity variations can for example be used to provide dampening.

According to a preferred embodiment, the inlet of the pump is communicated with a constituent mixing chamber, this mixing chamber being connected to the vessels by means of the valves and a damping device.

The method comprises for example using auxiliary chambers placed upstream from the mixing chamber, each provided with a deformable wall undergoing a constant pressure on one side and the pressure of a constituent on the opposite side.

The multi-constituent pumping system according to the invention comprises a pump and valves intended to cyclically communicate the inlet of the pump with vessels containing the constituents to be mixed. A dampening device dampens cyclic variations in the velocity of the constituents due to the opening and the closing of the valves.

The pumping system preferably comprises a mixing chamber communicating with the pump inlet and intermittently communicating with the dampening device by means of the valves.

According to a preferred embodiment, the dampening device comprises chambers placed upstream from the mixing chamber, each one provided with a deformable wall undergoing a constant pressure on one side and the pressure of a constituent on the opposite side.

According to a particular embodiment, the deformable wall in each auxiliary chamber is the wall of a bellows opening onto the outside.

The auxiliary chambers and the mixing chamber are for example chambers inside the same rigid body.

According to an embodiment, the system comprises a stirring device which stirs the mix in the mixing chamber, a motor and (for example magnetic type) linkage for connecting the motor to the stirring device.

According to a preferred embodiment, the pump inlet is communicated with a constituent mixing chamber, this mixing chamber being connected to the vessels by means of the valves and of the dampening device.

A variable-volume mixing chamber can be used, the system comprising means for changing the volume of this chamber according to the flow pumped and means for balancing the static pressure of the constituents to be mixed.

The dampening device of the velocity variations of each constituent can also comprise a variable-volume compensation chamber and a processor for varying the volume of each compensation chamber according to at least one parameter affecting the velocity of each constituent.

The valves are preferably on-off solenoid valves, the system comprising a processor for forming signals intended for respective control of these solenoid valves.

The pump preferably comprises a flow regulator which provides flow rate regulation at the input. It comprises for example two pumping units with phase-shifted reciprocating pistons, each communicating with the mixing chamber during the suction phase, these pistons being controlled by a drive associated with a processor. The pump preferably comprises a third pumping unit with a reciprocating piston, the control being suited to maintain the sum of the respective velocities of the three pistons constant during the suction phase.

BRIEF DESCRIPTION OF THE DRAWINGS

Other features and advantages of the process and of the device according to the invention will be clear from reading the description hereafter of a non limitative embodiment example, with reference to the accompanying drawings wherein.

DETAILED DESCRIPTION OF THE INVENTION

Figure 3:
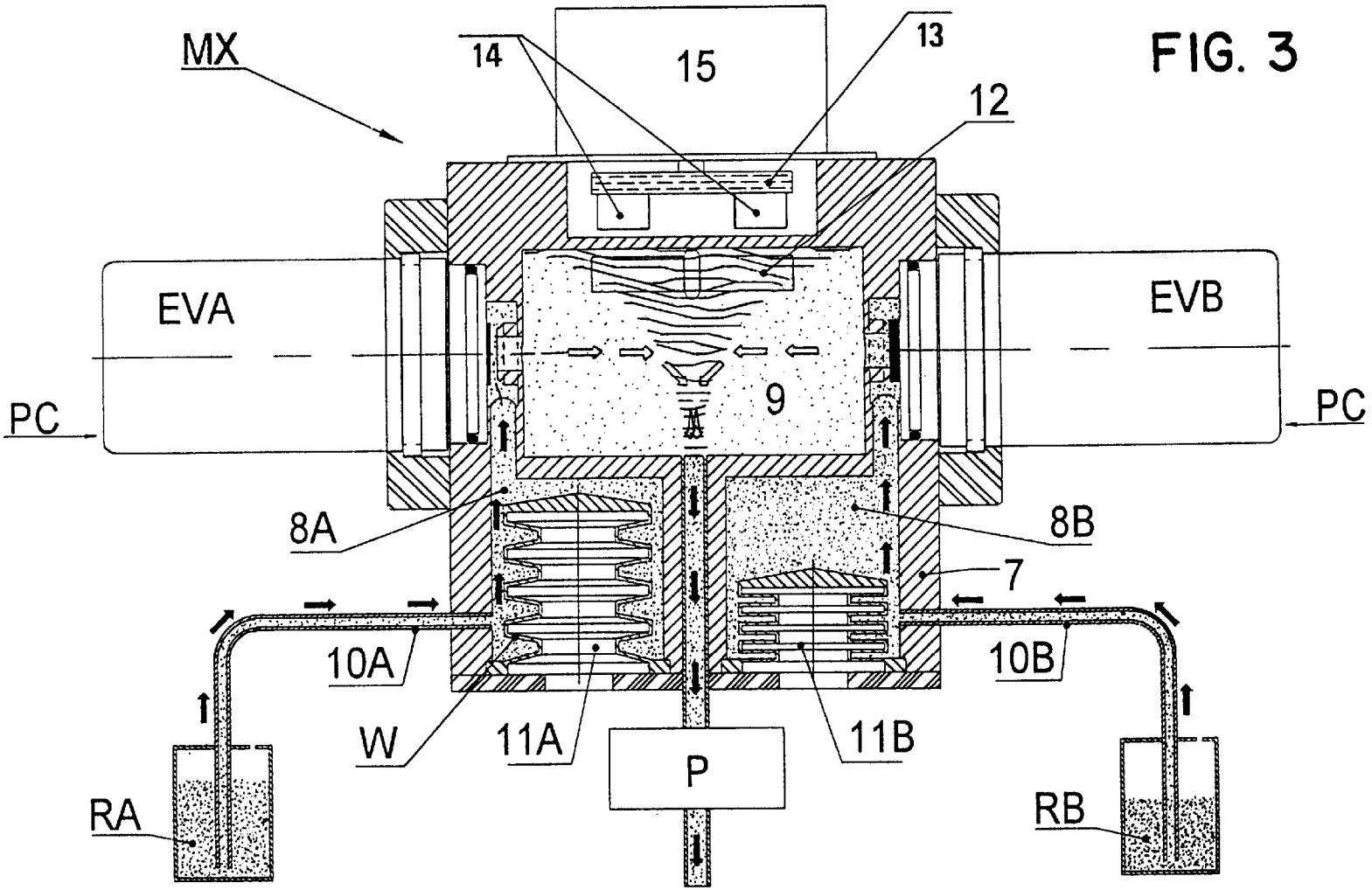
FIG. 3 shows a preferred embodiment of the mixing device according to the invention.

The pumping system according to the invention comprises (FIG. 3) a device MX for mixing a number n of components placed upstream from a pump P. In the example described hereafter, this number n is reduced to two for simplicity purposes.

Mixing device

Mixing device MX (FIG. 3) comprises, preferably in a single body 7, n (n=2 here) antechambers 8A, 8B upstream from a mixing chamber 9. Communication between each antechamber and mixing chamber 9 is made intermittent by on-off solenoid valves EVA (shown open) and EVB (shown closed) respectively. The two antechambers 8A, 8B communicate permanently, by means of lines 10A, 10B, with vessels RA, RB containing the liquid constituents to be mixed.

Each antechamber 8A, 8B contains a dampening device 11A, 11B for damping the accelerations and decelerations undergone by the liquids as a result of the intermittent opening and closing of solenoid valves EV1, EV2 consisting here of an extensible volume whose volume varies in relation to the cyclic velocity variations. A bellows whose outer surface is in contact with the liquid in each antechamber and whose inside communicates with the outside of body 7 can be used for example.

A homogenization device such as a rotating blade 12 is placed in the mixing chamber. A magnetized blade is preferably used and driven in rotation without contact from the outside of chamber 9 by means of a rotating disk 13 bearing magnets 14, the disk being coupled to a motor 15.

The presence of these bellows in the antechambers has the effect of considerably reducing the unwanted effects of sudden flow rate variations of the constituents. The pressure increase in antechamber 8B for example, resulting from the closing of the corresponding solenoid valve EVB, is automatically balanced by a contraction of bellows 11B. Conversely, the pressure decrease in antechamber 8A for example resulting from the opening of the corresponding solenoid valve EVA, is automatically balanced by an expansion of bellows 11A.

Running regularization is further improved if the dampening devices being placed as close as possible to the mixing chamber. By placing the elastically deformable volumes 11A, 11B as close as possible upstream from the solenoid valves and these solenoid valves as close as possible to pump P or mixing chamber 9, the mass of the liquid to be displaced when the solenoid valves open is decreased. This elastic volume must be calculated to absorb accelerations so that the negative pressure created is low enough in order not to cause cavitation in the liquids pumped and not to change the opening and closing times of the solenoid valves.

The previous mixing device can be placed upstream from a great variety of different pumps P, whether they have a regular suction capacity or not, but preferably upstream from the pumping device described hereafter.

Pumping device

The pumping device according to the invention comprises reciprocating pumping units with each having a phase of suction of the liquid mixture and a discharge phase.

Figure 4:
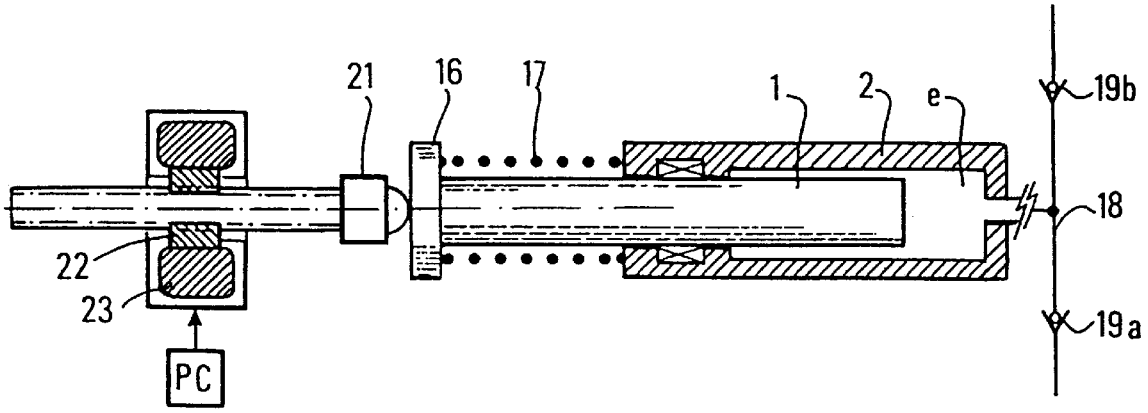
FIGS. 4 and 5 show two modes of driving reciprocating pumps, FIG. 6 diagrammatically shows the combination of the mixing device of FIG. 3 with a pump according to the invention in order to obtain controlled flow rates at the input as well as at the discharge end.
Figure 5:
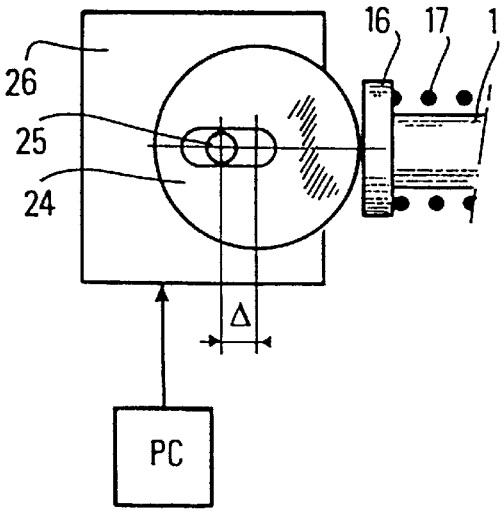

As described in the aforementioned patent French Patent 2,726,332 (U.S. Pat. No. 5,755,561), each pumping module comprises (FIGS. 4, 5) a rod 1 forming a piston, partly engaged in the inner cavity of a pump shell 2. Rod 1 is provided with a head 16. A spring 17 is placed between the head and the end of the shell so as to exert a permanent extraction force on the piston. At the opposite end thereof, the inner cavity of body 1 communicates with a line 18 provided with a one-way valve 19A such as a ball check valve for example, which opens during the suction phase when rod 1 moves backwards, and with another, similar valve 19B which opens during the discharge phase.

According to a first embodiment (FIG. 4), the extension of rod 1 in shell 2 is provided by the translation of an endless screw 20 resting on head 16 by means of a ball thrust 21. The screw translation comprises for example a nut 22 threaded to screw 20, which is for example housed in the hollow rotor of a stationary electric motor 23 and driven in rotation thereby. The direction of translation of the screw 20 is changed by inverting the direction of rotation of the motor at each pumping half-cycle.

According to a second embodiment (FIG. 5), the extension of rod 1 in shell 2 is provided by the rotation of a cam 24 resting against head 16, whose shaft 25 is driven in rotation by a motor 26. The extension of rod 1 in the inner cavity of shell 2 is obtained by changing the offset Δ of the cam on the shaft thereof. Motor 26 is driven by a control processor PC.

Figure 1:
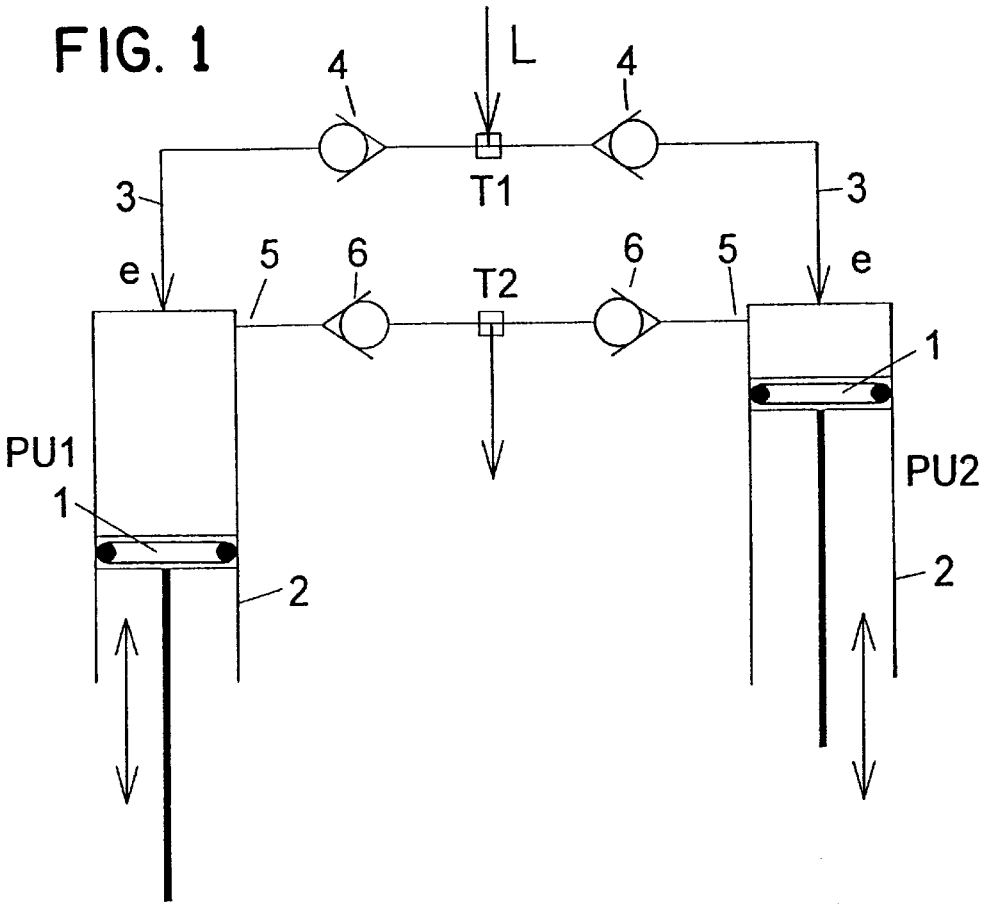
FIG. 1 diagrammatically shows a well-known layout for a pump with two reciprocating pumping units having a pulsed suction capacity, FIG. 2 diagrammatically shows a pumping system of a well-known type for mixing constituents by communicating cyclically vessels containing the constituents to be mixed, by means of valves, with a mixing head connected to the pump inlet.
Figure 2:
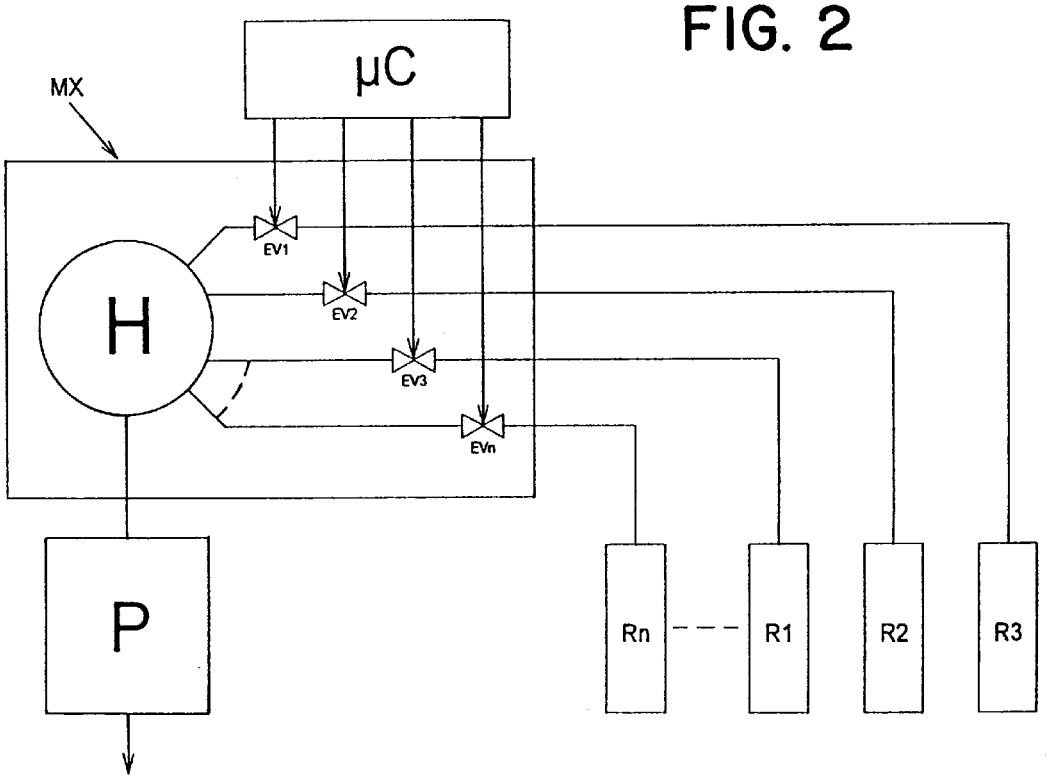

The pumping device according to the invention is improved in relation to the well-known embodiment of FIG. 1 so as to obtain a constant flow rate at the input as well as at the discharge end.

Figure 6:
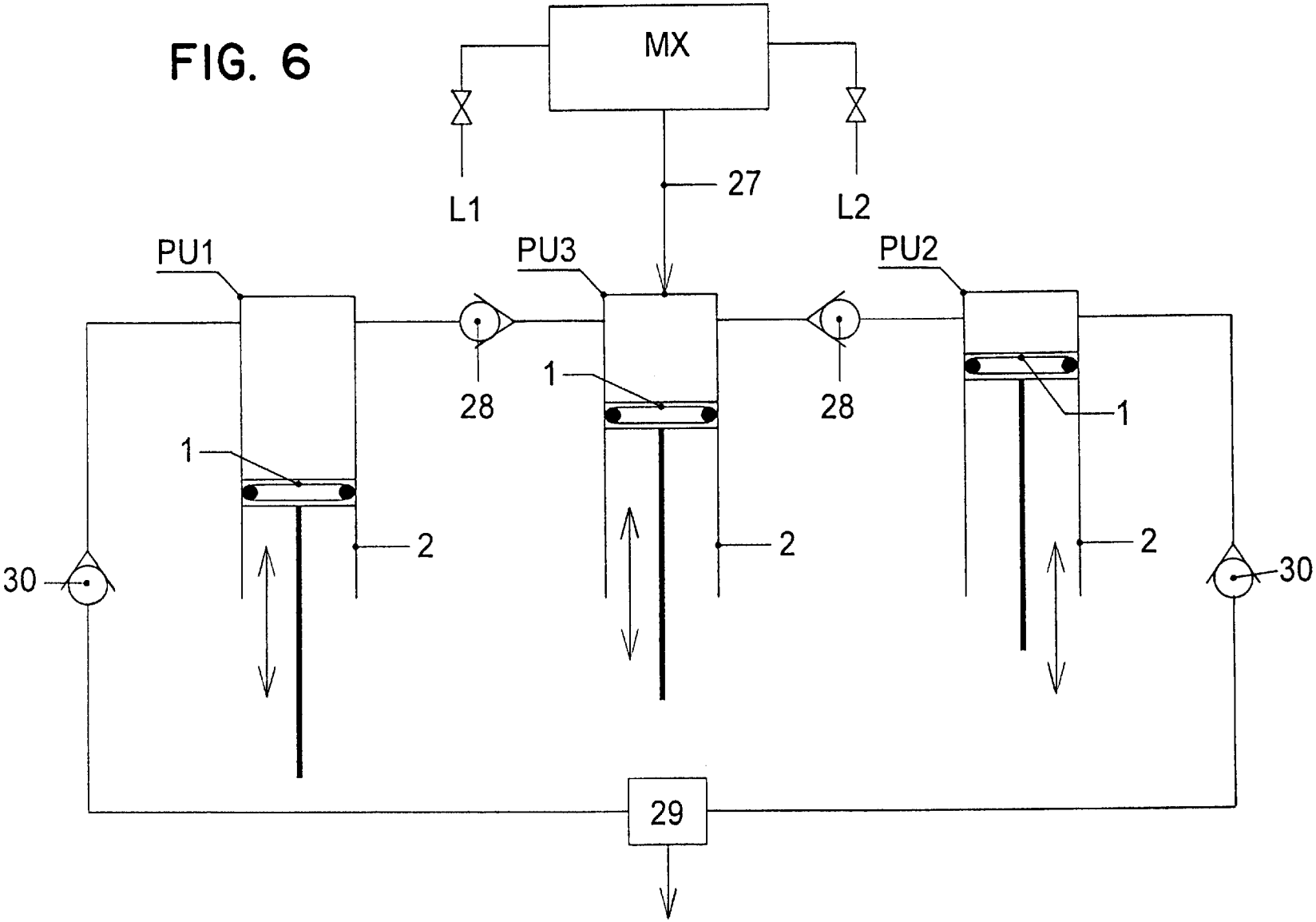

This result is obtained which is illustrated in FIG. 6, by using a third reciprocating pumping unit PU3 similar to the previous ones. This third unit PU3 permanently communicates with the outlet of mixing device MX by a line 27. Units PU1 and PU2 are fed by the liquid discharged by third unit PU3 through one-way valves 28. The liquid volumes are discharged by the two units PU1, PU2 towards a delivery tee 29, as previously, through one-way valves 30.

The desired flow rate regularization which is also sought at the pump inlet is obtained by permanently adjusting the velocity of displacement of piston 1 in third unit PU3 and the phase shift thereof in relation to the pistons of units PU1, PU2 so that the sum of the velocities of the three pistons is constant during the suction phase.

Figure 7:
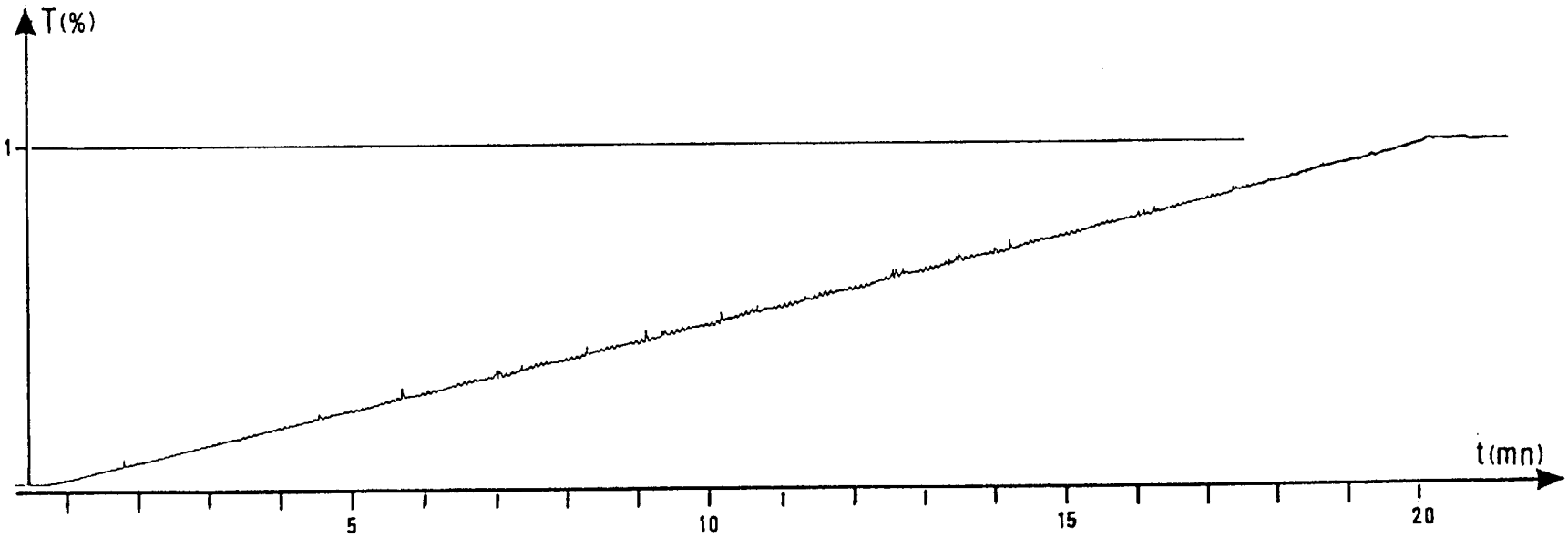
FIG. 7 shows the linear variation, in a 20 mn time interval, of the proportion of a substance in a mixture of a first constituent and of a second constituent containing this substance when the respective opening times of the solenoid valves of the mixer of FIG. 3 are gradually changed, one increasing and the other decreasing concomitantly.

With the described combination of the mixing device and of the pump thus regulated, when the form factor of the signal controlling the solenoid valves proportioning the various liquids varies according to the expected mixture, the accuracy obtained in the proportioning and the flow rate of a mixture is excellent, as can be clearly seen in FIG. 7. This also applies to the flow rate of the mixture which is reproducible, whatever the form factor of the signals controlling the various solenoid valves.

FIG. 7 illustrates the perfect linearity of the proportion variation of a substance mixed with one of the liquid constituents of a mixture when the respective opening times of the two solenoid valves of a mixing device according to the invention are varied with a constant sum of the opening times.

Figure 8:
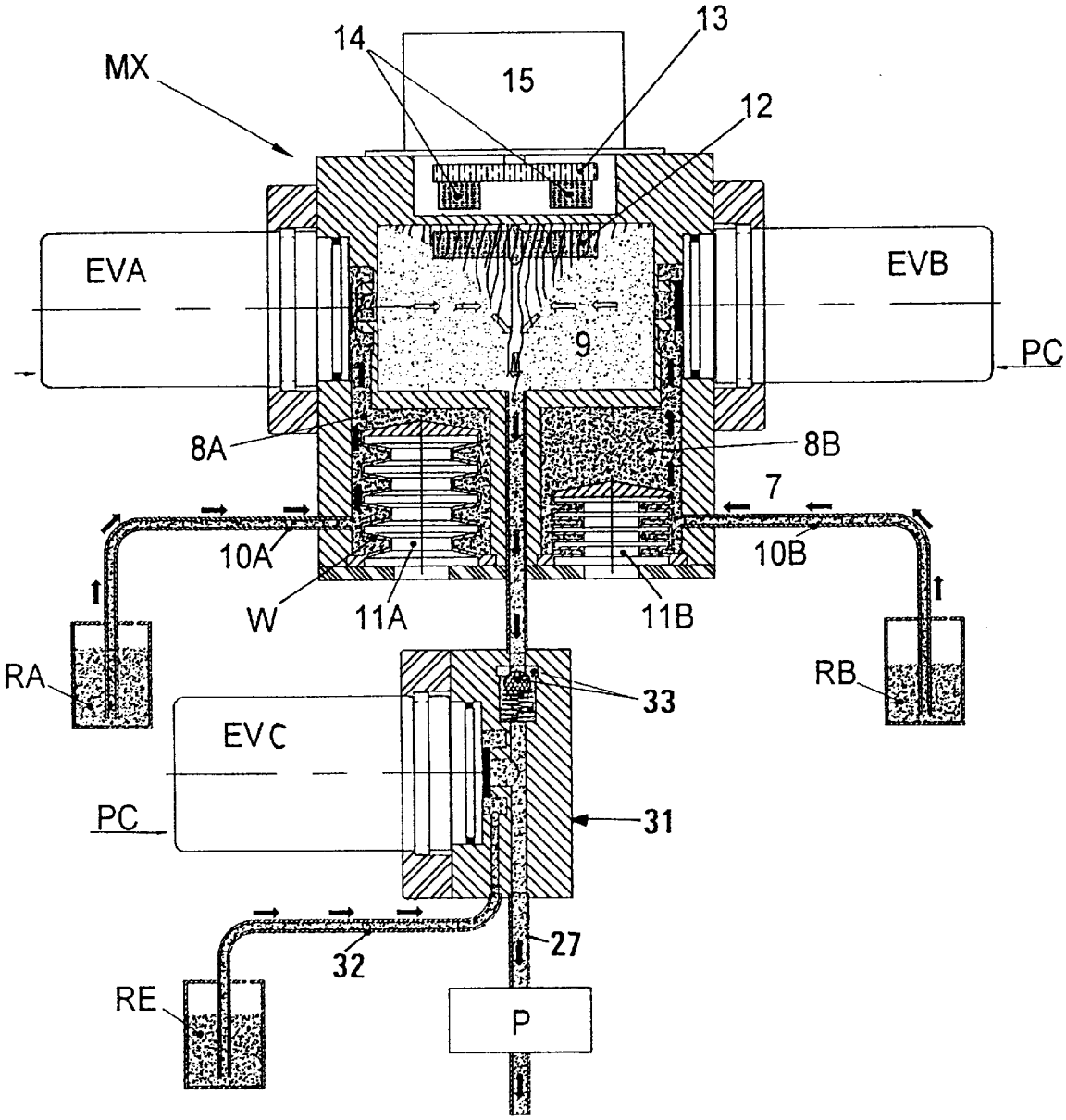
FIG. 8 shows a variant of the embodiment of FIG. 6 comprising a block intended for direct injection of the mixture into the pump.

According to the embodiment of FIG. 8, which is suitable for certain applications, an injector 31 allowing intermittent connection of an adjacent channel 32 connected to a vessel RE containing a mixture is interposed in circuit 27 between mixing device MX and pump P. This injector comprises a solenoid valve EVC also controlled by computer PC. A ball-and-spring type one-way check valve 33 for example is interposed in circuit 27. During the phase of injection of the mixture through adjacent channel 32, valves EVA, EVB of mixing device MX are maintained closed and solenoid valve EVC is opened. Check valve 33 prevents diffusion of the mixture injected towards mixing device MX. When the suction operations for the mixture from device MX are resumed, the predetermined proportions of the mixed constituents are thus guaranteed without any trailing effect.

Other embodiments can be used without departing from the scope of the invention.

a) A variable-volume mixing chamber whose volume is adjusted according to the flow pumped can be used for example.

b) It is also possible to apply to the bellows, on their face external to antechambers 8A, 8B, a constant back pressure that is however adjustable according to the pressure of the constituents admitted in mixer MX.

c) A preferred embodiment where the constituent velocity variations are regularized by compensation of the resulting pressure variations in both antechambers 8A, 8B has been described. It is however possible to use another regulation. For example, each bellows can be replaced by a variable-volume compensation chamber whose volume is permanently adjusted by a processor programmed to vary the volume of each compensation chamber according to at least one parameter affecting the velocity of each constituent. The processor can for example be so programmed that the acceleration applied to the constituents follows a certain predetermined variation profile.

What is claimed is:

1. A pumping system which mixes liquid constituents with precise proportioning of each one of the constituents, comprising:

a mixing chamber;

a pump with an inlet communicating with the mixing chamber;

vessels containing the liquid constituents;

valves allowing cyclic communication of the vessels containing the liquid constituents to be mixed with the inlet of the pump; and a bellows for damping cyclic velocity variations of each of the constituents caused by opening and closing of the valves.

2. A pumping system as claimed in claim 1, comprising:

means which applies to the bellows a constant back pressure which is adjustable according to a pressure of the constituents.

3. A pumping system as claimed in claim 1, comprising:

means which applies to the bellows a constant back pressure which is adjustable according to a pressure of the constituents.

4. A pumping system in accordance with claim 1 comprising:

auxiliary mixing chambers in fluid communication with the mixing chamber; and a single rigid body containing the mixing chamber and the auxiliary mixing chambers.

5. A pumping system in accordance with claim 1 wherein:

the dampening device comprises a variable volume compensation chamber; and further comprising a processor which controls the volume of the variable volume compensation chamber.

6. A pumping system as claimed in claim 2, wherein:

the bellows are placed in auxiliary chambers arranged between the vessels and the mixing chamber, and are provided with a deformable wall bearing a constant pressure on one side of the well and a pressure of a constituent on an opposite side of the wall.

7. A pumping system as claimed in claim 6, comprising:

a mixing chamber of adjustable volume.

8. A pumping system in accordance with claim 1 comprising:

a stirrer in the mixing chamber which stirs a mixture of the liquid constituents;

a motor; and drive connecting the stirrer to the motor.

9. A pumping system in accordance with claim 8 wherein:

the drive is magnetic.

10. A pumping system in accordance with claim 9 wherein:

the valves are on-off solenoid valves which are controlled by a controller.

11. A pumping system in accordance with claim 10 wherein:

the pump regulates a flow rate at the input.

12. A pumping system in accordance with claim 11 further comprising:

a pressure balance which balances static pressure of the constituents.

13. A pumping system which mixes liquid constituents with precise proportioning of each one of the constituents, comprising:

a mixing chamber;

a pump permanently communicating with the mixing chamber;

vessels containing the liquid constituents;

valves allowing cyclic communication of the mixing chamber with the vessels containing the liquid constituents to be mixed; and a bellows for damping cyclic velocity variations of each of the constituents caused by opening and closing of the valves.

14. A pumping system as claimed in claim 13, comprising:

a mixing chamber of adjustable volume.

15. A pumping system which mixes liquid constituents with precise proportioning of each of the constituents, comprising:

a mixing chamber;

a pump including two phase-shifted pump units each having an inlet and a reciprocating piston having a suction phase and a discharge phase which communicate during the suction phase with the mixing chamber;

vessels containing the liquid constituents to be mixed;

valves providing cyclic communication with the mixing chamber with the vessels containing the liquid constituents to be mixed;

a damping device which dampens cyclic velocity variations of the liquid constituents caused by opening and closing of the valves;

a processor which controls the pump units to maintain constant a sum of the respective velocities of the two reciprocating pistons;

a drive unit which drives the two phase-shifted pump units; and wherein the mixing chamber communicates with the respective inlets of the pump units and intermittently communicates with the damping device through the valves.

16. A pumping system as claimed in claim 15, comprising:

a third pump unit having a reciprocating piston, the drive unit maintaining constant a sum of the velocities of the three reciprocating pistons so as to maintain constant a suction rate of the pump.

17. A pumping system in accordance with claim 15 comprising:

auxiliary mixing chambers in fluid communication with the mixing chamber; and a single rigid body containing the mixing chamber and the auxiliary mixing chambers.

18. A pumping system in accordance with claim 15 wherein:

the dampening device comprises a variable volume compensation chamber; and a processor which controls the volume of the variable volume compensation chamber.

19. A pumping system in accordance with claim 15 comprising:

a stirrer in the mixing chamber which stirs a mixture of the liquid constituents;

a motor; and drive connecting the stirrer to the motor.

20. A pumping system in accordance with claim 19 wherein:

the drive is magnetic.

21. A pumping system in accordance with claim 20 wherein:

the valves are on-off solenoid valves which are controlled by a controller.

22. A pumping system in accordance with claim 21 wherein:

the pump regulates a flow rate at the inlet.

23. A pumping system in accordance with claim 22 further comprising:

a pressure balance which balances static pressure of the constituents.

24. A pumping system which mixes liquid constituents with precise proportioning of each one of the constituents, comprising:

a mixing chamber;

a pump with an inlet communicating with the mixing chamber;

vessels containing the liquid constituents;

valves providing cyclic communication of the vessels containing the liquid constituents to be mixed with the inlet of the pump;

dampening device which dampenings cyclic velocity variations of each of the constituents caused by opening and closing of the valves the dampening device including a variable-volume compensation chamber; and a processor which controls variation of a volume of the variable volume compensation chamber according to at least one parameter affecting the velocity of each constituent.

25. A pumping system in accordance with claim 24 comprising:

auxiliary mixing chambers in fluid communication with the mixing chamber; and a single rigid body containing the mixing chamber and the auxiliary mixing chambers.

26. A pumping system in accordance with claim 24 wherein:

the dampening device comprises a variable volume compensation chamber; and further comprising a processor which controls the volume of the variable volume compensation chamber.

27. A pumping system in accordance with claim 24 comprising:

a stirrer in the mixing chamber which stirs a mixture of the liquid constituents;

a motor; and drive connecting the stirrer to the motor.

28. A pumping system in accordance with claim 27 wherein:

the drive is magnetic.

29. A pumping system in accordance with claim 28 wherein:

the valves are on-off solenoid valves which are controlled by a controller.

30. A pumping system in accordance with claim 29 wherein:

the pump regulates a flow rate at the input.

31. A pumping system in accordance with claim 30 further comprising:

a pressure balance which balances static pressure of the constituents.

32. A pumping system which mixes liquid constituents with precise proportioning of each of the constituents, comprising:

a mixing chamber;

a pump permanently communicating with the mixing chamber;

vessels containing the liquid constituents;

valves providing cyclic communication of the mixing chamber with vessels containing the liquid constituents to be mixed;

a dampening device which dampens cyclic velocity variations of the constituents caused by opening and closing of the valves, the dampening device including a variable-volume compensation chamber; and a processor which controls variation of a volume of the variable-volume compensation chamber according to at least one parameter affecting the velocity of each constituent.

33. A pumping system as claimed in claim 32, comprising:

a mixing chamber of adjustable volume.

34. A pumping system in accordance with claim 32 comprising:

auxiliary mixing chambers in fluid communication with the mixing chamber; and a single rigid body containing the mixing chamber and the auxiliary mixing chambers.

35. A pumping system in accordance with claim 32 wherein:

the dampening device comprises a variable volume compensation chamber; and further comprising a processor which controls the volume of the variable volume compensation chamber.

36. A pumping system in accordance with claim 32 comprising:

a stirrer in the mixing chamber which stirs a mixture of the liquid constituents;

a motor; and drive connecting the stirrer to the motor.

37. A pumping system in accordance with claim 36 wherein:

the drive is magnetic.

38. A pumping system in accordance with claim 37 wherein:

the valves are on-off solenoid valves which are controlled by a controller.

39. A pumping system in accordance with claim 38 wherein:

the pump regulates a flow rate at the input.

40. A pumping system in accordance with claim 39 further comprising:

a pressure balance which balances static pressure of the constituents.

* * * * *